US009176411B2

(12) United States Patent
Sasaki et al.

(10) Patent No.: US 9,176,411 B2
(45) Date of Patent: Nov. 3, 2015

(54) ELECTROSTATIC CHARGE IMAGE DEVELOPING TONER, TONER CONTAINER, AND IMAGE FORMING APPARATUS

(71) Applicant: FUJI XEROX CO., LTD., Tokyo (JP)

(72) Inventors: Koji Sasaki, Kanagawa (JP); Satoshi Inoue, Kanagawa (JP); Yutaka Saito, Kanagawa (JP); Yasuaki Hashimoto, Kanagawa (JP); Emi Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/064,611

(22) Filed: Oct. 28, 2013

(65) Prior Publication Data

US 2014/0370427 A1 Dec. 18, 2014

(30) Foreign Application Priority Data

Jun. 18, 2013 (JP) ..... 2013-127743

(51) Int. Cl.
*G03G 9/097* (2006.01)
*G03G 15/08* (2006.01)

(52) U.S. Cl.
CPC ..... *G03G 9/09725* (2013.01); *G03G 15/0865* (2013.01)

(58) Field of Classification Search
CPC ..... G03G 9/09725
USPC ..... 430/108.6, 108.7; 399/222
See application file for complete search history.

(56) References Cited

U.S. PATENT DOCUMENTS

| | | | | |
|---|---|---|---|---|
| 5,342,876 | A * | 8/1994 | Abe et al. | 524/493 |
| 2011/0097661 | A1* | 4/2011 | Ishigami et al. | 430/108.7 |
| 2011/0318581 | A1* | 12/2011 | Zenitani et al. | 428/402 |
| 2012/0156601 | A1 | 6/2012 | Kitajima et al. | |
| 2012/0237867 | A1* | 9/2012 | Ishii | 430/108.7 |

FOREIGN PATENT DOCUMENTS

| | | |
|---|---|---|
| JP | A-2007-079144 | 3/2007 |
| JP | A-2012-128195 | 7/2012 |
| JP | A-2012-150172 | 8/2012 |

* cited by examiner

*Primary Examiner* — Peter Vajda
(74) *Attorney, Agent, or Firm* — Oliff PLC

(57) ABSTRACT

An electrostatic charge image developing toner includes toner particles and silica particles, wherein the silica particles have an average equivalent circle diameter of from 70 nm to 400 nm, an average circularity of from 0.5 to 0.9, and a pore volume of from 0.05 $cm^3/g$ to 2.5 $cm^3/g$.

12 Claims, 2 Drawing Sheets

ELECTROSTATIC CHARGE IMAGE DEVELOPING TONER, TONER CONTAINER, AND IMAGE FORMING APPARATUS

CROSS-REFERENCE TO RELATED APPLICATIONS

This application is based on and claims priority under 35 USC 119 from Japanese Patent Application No. 2013-127743 filed Jun. 18, 2013.

BACKGROUND

1. Technical Field

The present invention relates to an electrostatic charge image developing toner, a toner container, and an image forming apparatus.

2. Related Art

In electrophotography, typically, an image is formed through multiple processes including using various means to form an electrostatic charge image on a surface of a photoreceptor (image holding member) formed of a photoconductive material; developing the formed electrostatic charge image using a developer containing a toner to form a toner image; transferring the toner image onto a surface of a transfer medium such as paper, and optionally, through an intermediate transfer medium; and fixing the toner image on the surface of the transfer medium, for example, by applying heat or pressure or applying both heat and pressure.

As the toner for forming this image, a toner containing toner particles that contains a binder resin and a colorant; and an external additive that is externally added to the toner particles is used in many cases.

SUMMARY

According to an aspect of the invention, there is provided an electrostatic charge image developing toner including toner particles and silica particles, wherein the silica particles have an average equivalent circle diameter of from 70 nm to 400 nm, an average circularity of from 0.5 to 0.9, and a pore volume of from 0.05 $cm^3/g$ to 2.5 $cm^3/g$.

BRIEF DESCRIPTION OF THE DRAWINGS

Exemplary embodiments of the present invention will be described in detail based on the following figures, wherein.

DETAILED DESCRIPTION

Figure 1:
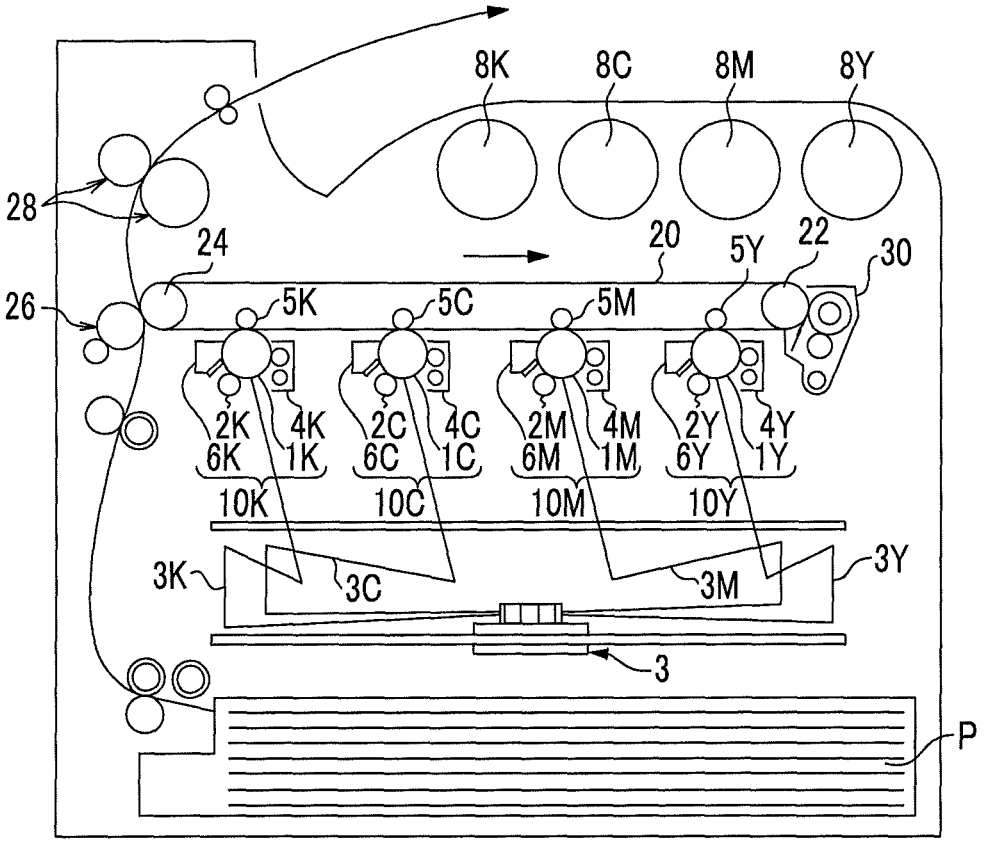
FIG. 1 is a schematic diagram illustrating a configuration of an example of an image forming apparatus according to an exemplary embodiment of the invention.

Hereinafter, exemplary embodiments of the invention will be described in detail.

Electrostatic Charge Image Developing Toner

An electrostatic charge image developing toner (hereinafter, simply referred to as "toner") includes toner particles; and silica particles as an external additives. The silica particles have an average equivalent circle size of from 70 nm to 400 nm, an average circularity of from 0.5 to 0.9, and a pore volume of from 0.05 $cm^3/g$ to 2.5 $cm^3/g$.

By using the toner according to the exemplary embodiment having the above-described configuration, an image in which transfer omission is suppressed can be obtained.

The reason is not clear, but is considered to be as follows.

A toner, to which irregular and large-size silica particles (hereinafter, referred to as "irregular silica particles) that have an average equivalent circle size of from 70 nm to 400 nm and an average circularity of from 0.5 to 0.9 are externally added, is known.

However, the irregular silica particles are likely to remain on convex portions of toner particles even after being applied with a mechanical load of developing unit and still function as a spacer. Therefore, it is considered that adhesion between the toner is likely to be decreased even after being applied with a mechanical load of developing unit. As a result, when an image is formed using the toner to which the irregular silica particles are externally added, transfer omission may occur.

On the other hand, in the toner according to the exemplary embodiment, the occurrence of transfer omission is suppressed by controlling a pore volume of irregular silica particles to be in a range from 0.05 $cm^3/g$ to 2.5 $cm^3/g$.

In the exemplary embodiment, it is considered that, when the pore volume of the irregular silica particles is in the specific range from 0.05 $cm^3/g$ to 2.5 $cm^3/g$, water is likely to be adsorbed onto surfaces thereof. It is considered that, when such irregular silica particles are externally added to toner particles, water adsorbed on the surfaces of the irregular silica particles increases an interaction (for example, liquid crosslinking force), and adhesion between the toner is likely to be improved. Accordingly, it is considered that, when a toner image is transferred from an image holding member, a phenomenon in which a part of the toner image is not transferred is not likely to occur, thereby obtaining an image in which transfer omission is suppressed.

As a result, it is considered that an image in which transfer omission is suppressed is obtained by using the toner according to the exemplary embodiment having the above-described configuration.

Particularly, in a low-temperature low-humidity environment (for example, 10° C. and 10 RH %), normally, it is difficult for irregular silica particles to retain water, an interaction (for example, liquid crosslinking force) is decreased, and transfer omission is likely to occur. However, irregular silica particles which satisfy the above-described volume pore are likely to adsorb water on surfaces thereof even in the low-temperature, low-humidity environment (for example, 10° C. and 10 RH %). Therefore, it is considered that an image in which transfer omission is suppressed is likely to be obtained by using the toner according to the exemplary embodiment. In addition, even when an image having thin lines such as a character or a line drawing in which transfer omission is likely to occur is obtained, adhesion between the toner is improved. Therefore, it is considered that an image in which transfer omission is suppressed is likely to be obtained.

In addition, in the exemplary embodiment, since the irregular silica particles have a pore volume in the above-described range, an interaction (for example, liquid crosslinking force) is likely to be increased, and adhesion between the toner and a transfer medium (for example, an intermediate transfer medium) is likely to be increased. In addition, since the irregular silica particles have an irregular shape, an anchor effect is likely to be exerted. As a result, it is considered that the toner according to the exemplary embodiment is not likely to be scattered on a transfer medium (for example, an intermediate transfer medium).

Hereinafter, the toner according to the exemplary embodiment will be described in detail.

The toner according to the exemplary embodiment includes toner particles and, optionally, further includes an external additive.

Toner Particles

The toner particles include, for example, a binder resin and, optionally, further include a colorant, a release agent, and other additives.

Binder Resin

Examples of the binder resin include vinyl-based resins formed of homopolymers of the following monomers or copolymers obtained by combining two or more kinds of the monomers, the monomers including styrenes (for example, styrene, p-chlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene and butadiene).

Examples of the binder resin include non-vinyl-based resins such as epoxy resins, polyester resins, polyurethane resins, polyamide resins, cellulose resins, polyether resins, and modified rosin; mixtures thereof with the above-described vinyl-based resins; and graft polymers obtained by polymerizing a vinyl-based monomer with the coexistence of such non-vinyl-based resins.

These binder resins may be used alone or in a combination of two or more kinds thereof.

As the binder resin, a polyester resin is preferable.

Examples of the polyester resin include well-known polyester resins.

Examples of the polyester resin include a condensation polymer of a polyvalent carboxylic acid and a polyol. As an amorphous polyester resin, a commercially available product or a synthesized product may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, and lower alkyl esters (having, for example, from 1 to 5 carbon atoms) thereof. Among these, for example, aromatic dicarboxylic acids are preferable as the polyvalent carboxylic acid.

As the polyvalent carboxylic acid, a combination of a tri- or higher-valent carboxylic acid employing a crosslinked structure or a branched structure with a dicarboxylic acid may be used. Examples of the tri- or higher-valent carboxylic acid include trimellitic acid, pyromellitic acid, anhydrides thereof, and lower alkyl esters (having, for example, from 1 to 5 carbon atoms) thereof.

The polyvalent carboxylic acids may be used alone or in a combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferable, and aromatic diols are more preferable as the polyol.

As the polyol, a combination of a tri- or higher-valent polyol employing a crosslinked structure or a branched structure with diol may be used. Examples of the tri- or higher-valent polyol include glycerin, trimethylolpropane, and pentaerythritol.

The polyols may be used alone or in a combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K-1987.

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using HLC-8120 (GPC manufactured by Tosoh Corporation) as a measuring device, TSK gel Super HM-M (column manufactured by Tosoh Corporation; 15 cm), and a THF solvent. The weight average molecular weight and the number average molecular weight are calculated using a molecular weight calibration curve plotted from a monodisperse polystyrene standard sample from the results of the above measurement.

Examples of a method of preparing the polyester resin include a well-known method, specifically, a method of setting a polymerization temperature to be in a range from 180° C. to 230° C., optionally reducing the internal pressure of the reaction system, and causing a reaction while removing water or an alcohol generated during condensation.

When monomers of the raw materials are not soluble or compatible with each other at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be preliminarily condensed and then polycondensed with the major component.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as carbon black, chrome yellow, Hansa yellow, benzidine yellow, indanthrene yellow, quinoline yellow, pigment yellow, permanent orange GTR, pyrazolone orange, vulcan orange, watch young red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate, and various dyes such as acridine-based dyes, xanthene-based dyes, azo-based dyes, benzoquinone-based dyes, azine-based dyes, anthraquinone-based dyes, thioindigo-based dyes, dioxadine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

The colorants may be used alone or in a combination of two or more kinds thereof.

Optionally, the colorant may be surface-treated or used in combination with a dispersant. In addition, plural kinds of colorants may be used in combination.

The content of the colorant is, for example, preferably from 1% by weight to 30% by weight, and more preferably from 3% by weight to 15% by weight with respect to the entire toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from the "melting peak temperature" described in the method of obtaining a melting temperature in the "testing methods for transition temperatures of plastics" in JIS K-1987, based on a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include well-known additives such as a magnetic material, a charge-controlling agent, and inorganic powder. The toner particles include these additives as internal additives.

Characteristics of Toner Particles

The toner particles may have a single-layer structure, or a so-called core-shell structure including a core (core particle) and a coating layer (shell layer) that is coated on the core part.

Here, it is preferable that toner particles having a core-shell structure include, for example, a core that includes a binder resin and, optionally, further includes other additives such as a colorant and a release agent; and a coating layer that includes a binder resin.

The volume particle size (D50v) of the toner particles is preferably from 2 μm to 10 μm and more preferably from 4 μm to 8 μm.

In order to measure various particle sizes and various particle size distributions of the toner particles, Coulter Multisizer II (manufactured by Beckman Coulter Inc.) is used, and ISOTON-II (manufactured by Beckman Coulter Inc.) is used as an electrolytic solution.

During the measurement, 0.5 mg to 50 mg of measurement sample is added to 2 ml of aqueous solution which contains 5% of surfactant (preferably, sodium alkylbenzene sulfonate) as a dispersant. The obtained solution is added to 100 ml to 150 ml of electrolytic solution.

The electrolytic solution in which the sample is suspended is dispersed using an ultrasonic disperser for 1 minute. Then, using Coulter Multisizer II, the particle size distribution of particles having a particle size in a range from 2 μm to 60 μm is measured using an aperture with an aperture size of 100 μm. The number of particles which are sampled is 50000.

In particle size ranges (channels) which are divided based on the measured particle size distribution, cumulative distributions based on the volume and number are plotted from the smallest diameter side. Particle sizes having a cumulative value of 16% are defined as a volume particle size D16v and a number particle size D16p, particle sizes having a cumulative value of 50% are defined as a volume particle size D50v and a number particle size D50p, and particle sizes having a cumulative value of 84% are defined as a volume particle size D84v and a number particle size D84p.

Based on these values, a volume average particle size distribution index (GSDv) is calculated from an expression of $(D84v/D16v)^{1/2}$, and a number average particle size distribution index (GSDp) is calculated from an expression of $(D84p/D16p)^{1/2}$.

A shape factor SF1 of the toner particles is preferably from 110 to 150 and more preferably from 120 to 140.

The shape factor SF1 is obtained from the following expression.

Expression: $SF1=(ML^2/A)\times(\pi/4)\times 100$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, optical microscopic images of particles scattered on a surface of a glass slide are input to an image analyzer Luzex through a video camera to obtain maximum lengths and projected areas of 100 particles, values of SF1 are calculated using the above expression, and an average value thereof is obtained.

(External Additive)

In the exemplary embodiment, irregular silica particles are applied as the external additive.

The irregular silica particles have an average equivalent circle diameter of from 70 nm to 400 nm, an average circularity of from 0.5 to 0.9, and a pore volume of from 0.05 $cm^3/g$ to 2.5 $cm^3/g$.

Hereinafter, the physical properties and characteristics of the irregular silica particles will be described.

Particle Size

The average equivalent circle diameter of the irregular silica particles is from 70 nm to 400 nm, preferably from 70 nm to 250 nm, and more preferably from 80 nm to 200 nm.

When the average equivalent circle diameter of the irregular silica particles is greater than or equal to 70 nm, the burial thereof into the toner particles is suppressed, and a function as the external additive (function as a spacer) is likely to be secured.

Meanwhile, when the average equivalent circle diameter of the irregular silica particles is less than or equal to 400 nm, the separation thereof from the toner particles is suppressed. As a result, an image holding member is not damaged by separated irregular silica particles, and image defects which are generated over time are suppressed.

The average equivalent circle diameter of the irregular silica particles is obtained by imaging 100 primary particles of the irregular silica particles with a SEM device, calculating equivalent circle diameters of the primary particles with an image analysis software WinROOF (manufactured by Mitani Corporation) according to the following expression, and obtaining the average of the equivalent circle diameters.

Expression: Equivalent Circular Diameter=$2\sqrt{(\text{Area}/\pi)}$ (In the above expression, the area represents a projected area of an irregular silica particle)

Circularity

In addition, the average circularity of the irregular silica particles is from 0.5 to 0.9, preferably from 0.65 to 0.9, and more preferably from 0.70 to 0.85.

When the average circularity of the irregular silica particles is greater than or equal to 0.5, stress concentration is suppressed after applying a mechanical load, and defects by the mechanical load is suppressed.

Meanwhile, when the average circularity of the irregular silica particles is less than or equal to 0.9, the shape is an irregular shape. As a result, the movement of the irregular silica particles to concave portions of the toner particles is suppressed, and a function as the external additive (function as a spacer) is likely to be obtained. In addition, adhesion is improved by the anchor effect of the irregular silica particles, and toner scattering is likely to be suppressed.

The circularity of an irregular silica particle is obtained by observing a primary particle of the external additive with a SEM device after dispersing the irregular silica particles in the toner particles, analyzing the obtained image of the primary particle, and calculating the value of "100/SF2" from the following expression.

Expression: Circularity(100/SF2)=$4\pi\times(A/I^2)$

In the above expression, I represents a perimeter of a primary particle of an irregular silica particle on an image, A represents a projected area of a primary particle of the external additive, and SF2 represents a shape factor.

The average circularity of the irregular silica particles is obtained as a 50% circularity in a cumulative frequency of equivalent circle diameters of 100 primary particles which is obtained by the above-described image analysis.

Pore Volume

The pore volume of the irregular silica particles is from 0.05 $cm^3/g$ to 2.5 $cm^3/g$ and preferably from 0.05 $cm^3/g$ to 1.2 $cm^3/g$.

When the pore volume of the irregular silica particles is from 0.05 $cm^3/g$ to 2.5 $cm^3/g$, the occurrence of transfer omission is suppressed.

Pore Size

The pore size of the irregular silica particles is from 1.7 nm to 150 nm, preferably from 3.0 nm to 100 nm, and more preferably from 5 nm to 25 nm.

When the pore size of the irregular silica particles is from 5 nm to 25 nm, water is sufficiently retained in the pores, an interaction between silica and water is strong, and an effect of suppressing transfer omission is high. When the pore size is too small, a space into which water molecules are incorporated is small. Therefore, an effect of suppressing transfer omission is decreased. On the other hand, when the pore size is too large, an interaction between silica and water does not act on water in the pore center, and the water retention capacity is decreased.

The pore size and pore volume of the irregular silica particles are calculated using a pore distribution measuring device (TRISTAR 3000, manufactured by Micromeritics Instrument Corporation) after adsorbing nitrogen molecules onto the irregular silica particles. Specifically, approximately 0.5 g of sample is put into a sample tube, followed by vacuuming at 100° C. for 24 hours. From the obtained sample, the average pore volume; and the total pore volume in a pore size range from 1.7 nm to 300.0 nm are obtained using the above-described pore distribution measuring device according to the BJH adsorption method.

Method of Preparing Irregular Silica Particles

Irregular silica particles may be manufactured with a so-called wet method, for example, a method of using water glass as a raw material to obtain silica or a method of using a silicon compound such as alkoxysilane as a raw material and producing particles according to a sol-gel method.

Hereinafter, a method of preparing irregular silica particles according to the exemplary embodiment will be described.

The method of preparing irregular silica particles according to the exemplary embodiment include a step (hereinafter, also referred to as "alkali catalyst solution preparing step") of preparing an alkali catalyst solution in which an alkali catalyst is contained in a solvent containing an alcohol at a concentration of from 0.6 mol/L to 0.87 mol/L; and a step (hereinafter, also referred to as "particle forming step") of supplying, tetraalkoxysilane, an alkali catalyst, and a silanol group-reactive sealant into the alkali catalyst solution, in which the supply amount of the alkali catalyst is, for example, from 0.1 mol to 0.4 mol with respect to 1 mol of the total supply amount of tetraalkoxysilane supplied per minute, and the supply amount of the silanol group-reactive sealant is, for example, from 0.004 mol to 0.50 mol with respect to 1 mol of the total supply amount of tetraalkoxysilane supplied per minute.

That is, in the method of preparing irregular silica particles according to the exemplary embodiment, in the presence of the alcohol containing the above-described concentration of alkali catalyst, tetraalkoxysilane which is a raw material and, separately, an alkali catalyst solution which is a catalyst and a silanol group-reactive sealant are supplied while satisfying the above-described relationships to cause a reaction of tetraalkoxysilane, thereby producing the irregular silica particles.

With the above-described method of preparing irregular silica particles according to the exemplary embodiment, irregular silica particles having a small amount of coarse aggregates, an irregular shape satisfying the above-described properties, and a pore volume of from 0.05 $cm^3/g$ to 2.5 $cm^3/g$ are obtained.

In particular, in the method of preparing irregular silica particles according to the exemplary embodiment, irregular silica particles having a pore volume of from 0.05 $cm^3/g$ to 2.5 $cm^3/g$ are obtained. Therefore, as compared to irregular silica particles having a small number of pores on surfaces thereof which are obtained with a dry method, water is likely to be adsorbed on the surfaces of the irregular silica particles, adhesion between the toner is likely to be improved due to an interaction (for example, liquid crosslinking force), and as a result, irregular silica particles with which transfer omission is suppressed are likely to be manufactured.

The reason is not clear, but is considered to be as follows.

First, an alkali catalyst solution is prepared in which an alkali catalyst is contained in a solvent containing an alcohol. When tetraalkoxysilane and an alkali catalyst are supplied to this solution, tetraalkoxysilane supplied to the alkali catalyst solution causes a reaction, and nuclear particles are formed. At this time, it is considered that, when a silanol group-reactive sealant is supplied simultaneously with the supply of tetraalkoxysilane and the alkali catalyst or after the supply and the nuclear particle growth, irregular silica particles having a pore volume of from 0.05 $cm^3/g$ to 2.5 $cm^3/g$ are prepared. When the silanol group-reactive sealant is not supplied during the growth of the formed nuclear particles, because silanol groups tend to have high reaction activity, for example, a condensation reaction is caused between silanol groups in the pores of irregular silica particles to forma siloxane bond. As a result, irregular silica particles in which the surface pore size becomes narrow or pores are disappeared are prepared. On the other hand, when the silanol group-reactive sealant is supplied during the growth of the formed nuclear particles, silanol groups in the pores are substituted with substituents (for example, alkoxy groups) which are not reactive with a silanol group. Therefore, it is considered that silanol groups do not cause, for example, a condensation reaction easily, and the surface pore size does not become narrow easily or pores are not disappeared easily.

It is considered that the supply amount of tetraalkoxysilane relates to the particle size distribution and circularity of the irregular silica particles. It is considered that, when the supply amount of tetraalkoxysilane is greater than or equal to 0.002 mol/(mol·min) and less than 0.0055 mol/(mol·min), the contact probability between tetraalkoxysilane which is added dropwise and the nuclear particles is decreased, tetraalkoxysilane is uniformly supplied to the nuclear particles before tetraalkoxysilane reacts with each other. Accordingly, it is considered that tetraalkoxysilane and the nuclear particles may be allowed to react with each other uniformly. As a result, it is considered that a variation in particle growth is suppressed, and irregular silica particles in which a distribution width is narrow may be manufactured.

It is considered that the average equivalent circle diameter of the irregular silica particles depends on the total supply amount of tetraalkoxysilane.

In addition, in the method of preparing irregular silica particles according to the exemplary embodiment, it is considered that nuclear particles having an irregular shape are formed, and the nuclear particles are grown while maintaining this irregular shape to prepare irregular silica particles. Therefore, it is considered that irregular silica particles having high shape stability to a mechanical load are obtained.

In addition, in the method of preparing irregular silica particles according to the exemplary embodiment, it is considered that the formed irregular nuclear particles are grown while maintaining their irregular shape to prepare irregular silica particles. Therefore, it is considered that irregular silica particles that have high resistance to a mechanical load and are difficult to crack are obtained.

In addition, in the method of preparing irregular silica particles according to the exemplary embodiment, tetraalkoxysilane and the alkali catalyst are respectively supplied to the alkali catalyst solution to cause the reaction of tetraalkoxysilane, thereby forming particles. Therefore, as compared to a case where irregular silica particles are prepared using a sol-gel method of the related art, the total amount of an alkali catalyst used is decreased, and thus, a step of removing an alkali catalyst may also be omitted. This method is effective when irregular silica particles are applied to a product requiring high purity.

The silanol group-reactive sealant represents a sealant which reacts with a silanol group of irregular silica particles to form a substituent which is not reactive with a silanol group.

It is considered that, when the supply amount of the silanol group-reactive sealant is, for example, from 0.000008 mol/(mol·min) to 0.00275 mol/(mol·min), in the particle forming step, the supplied silanol group-reactive sealant reacts with a silanol group in the pores of surfaces of irregular silica particles to interfere with a condensation reaction between silanol groups. Therefore, it is considered that the pore volume of irregular silica particles is easily controlled to be in a specific range by the supply amount of the silanol group-reactive sealant.

Hereinafter, each step in the method of preparing irregular silica particles will be described in detail.

Alkali Catalyst Solution Preparing Step

First, the alkali catalyst solution preparing step will be described.

In the alkali catalyst solution preparing step, a solvent containing an alcohol is prepared, and an alkali catalyst is added to the solvent to prepare an alkali catalyst solution.

As the solvent containing an alcohol, a solvent containing only an alcohol may be used, or optionally, a mixed solvent of an alcohol and another solvent, for example, water, ketones such as acetone, methyl ethyl ketone, and methyl isobutyl ketone, cellosolves such as methyl cellosolve, ethyl cellosolve, butyl cellosolve, and cellosolve acetate, or ethers such as dioxane and tetrahydrofuran.

In the case of the mixed solvent, the amount of alcohol is preferably greater than or equal to 80% by weight (more preferably greater than or equal to 90% by weight) with respect to the amount of the another solvent.

Examples of the alcohol include lower alcohols such as methanol and ethanol.

Meanwhile, as the alkali catalyst, a catalyst for accelerating the reaction (hydrolysis reaction, condensation reaction) of tetraalkoxysilane is used, and examples thereof include basic catalysts such as ammonia, urea, monoamine, and quarternary ammonium salts. Among these, ammonia is particularly preferable.

The concentration (content) of the alkali catalyst is from 0.6 mol/L to 0.87 mol/L, preferably from 0.63 mol/L to 0.78 mol/L, and more preferably from 0.66 mol/L to 0.75 mol/L.

When the concentration of the alkali catalyst is less than 0.6 mol/L, the dispersibility of the formed nuclear particles is unstable during the growth. As a result, coarse aggregates such as secondary aggregates may be formed, gelation may occur, or a particle size distribution may deteriorate.

On the other hand, when the concentration of the alkali catalyst is greater than 0.87 mol/L, the stability of the formed nuclear particles is excessive. As a result, spherical nuclear particles may be formed, and it may be difficult to obtain irregular nuclear particles having an average circularity of 0.90 or less.

The concentration of the alkali catalyst is the concentration in the alkali catalyst solution (alkali catalyst+solvent containing an alcohol).

Particle Forming Step

Next, the particle forming step will be described.

In the particle forming step, tetraalkoxysilane, an alkali catalyst, and a silanol group-reactive sealant are respectively supplied to the alkali catalyst solution to allow tetraalkoxysilane to react (hydrolysis reaction, condensation reaction) in the alkali catalyst solution, thereby forming irregular silica particles.

In the particle forming step, irregular silica particles are formed through a step (nuclear particle forming step) of forming nuclear particles due to the reaction of tetraalkoxysilane in the initial stage of supplying tetraalkoxysilane; and a step (nuclear particle growing step) of growing the nuclear particles. It is considered that, during the growth of the nuclear particles, silanol groups in the pores of irregular silica particles are substituted with substituents which are not reactive with a silanol group by the silanol group-reactive sealant, thereby obtaining a pore volume of from 0.05 $cm^3/g$ to 2.5 $cm^3/g$.

In this case, the silanol group-reactive sealant may be supplied during the supply of tetraalkoxysilane and the alkali catalyst or after the supply and the nuclear particle formation.

Examples of tetraalkoxysilane to be supplied to the alkali catalyst solution include tetramethoxysilane, tetraethoxysilane, tetrapropoxysilane, and tetrabutoxysilane. Among these, tetramethoxysilane and tetraethoxysilane are preferable from the viewpoints of the controllability of a reaction rate; the shape, particle size, and particle size distribution of the obtained irregular silica particles; and the like.

The supply amount of tetraalkoxysilane is from 0.002 mol/(mol·min) to 0.0055 mol/(mol·min) with respect to the alcohol in the alkali catalyst solution.

This means that tetraalkoxysilane is supplied at a supply amount of from 0.002 mol to 0.0055 mol per minute with respect to 1 mol of alcohol which is used in the step of preparing the alkali catalyst solution.

The particle size of irregular silica particles is controlled by a reaction temperature. The higher the reaction temperature, the less the particle size, and the lower the reaction temperature, the greater the particle size.

When the supply amount of tetraalkoxysilane is less than 0.002 mol/(mol·min), the contact probability between tetraalkoxysilane which is added dropwise and the nuclear particles is decreased, but a long period of time is required for completion of the dropwise addition of the total supply amount of tetraalkoxysilane, which impairs production efficiency.

When the supply amount of tetraalkoxysilane is greater than 0.0055 mol/(mol·min), it is considered that a reaction of tetraalkoxysilane is caused before the reaction of tetraalkoxysilane which is added dropwise and the nuclear particles. Therefore, tetraalkoxysilane is likely to be supplied to the nuclear particles nonuniformly, which brings about a variation in nuclear particle formation. As a result, the width of a shape distribution is increased, and it is difficult to prepare silica having a standard deviation of circularity of 0.3 or less.

The supply amount of tetraalkoxysilane is preferably from 0.002 mol/(mol·min) to 0.0045 mol/(mol·min) and more preferably from 0.002 mol/(mol·min) to 0.0035 mol/(mol·min).

Examples of the alkali catalyst which is supplied to the alkali catalyst solution are as described above. The alkali catalyst to be supplied may be the same type of catalyst as or a different type of catalyst from that of the alkali catalyst which is contained in advance in the alkali catalyst solution. However, it is preferable that the same type of catalyst be used.

The supply amount of the alkali catalyst is from 0.1 mol to 0.4 mol, preferably from 0.14 mol to 0.35 mol, and more preferably from 0.18 mol to 0.30 mol with respect to 1 mol of the total supply amount of tetraalkoxysilane supplied per minute.

When the supply amount of the alkali catalyst is less than 0.1 mol, the dispersibility of the formed nuclear particles is unstable during the growth. As a result, coarse aggregates such as secondary aggregates may be formed, gelation may occur, or a particle size distribution may deteriorate.

On the other hand, when the supply amount of the alkali catalyst is greater than 0.4 mol, the stability of the formed nuclear particles is excessive. As a result, even when nuclear particles having a low circularity are formed in the nuclear particle forming step, the nuclear particles may be grown in a spherical shape in the nuclear particle growing step, and irregular silica particles having a low circularity may not be obtained.

In the particle forming step, tetraalkoxysilane, an alkali catalyst, and a silanol group-reactive sealant are respectively supplied to the alkali catalyst solution. At this time, the supply method may be a method of continuously supplying the above materials or a method of intermittently supplying the above materials.

Examples of the silanol group-reactive sealant include an organic silicon compound.

Examples of the organic silicon compound include well-known organic silicon compounds having a functional group such as an alkyl group (for example, a methyl group, an ethyl group, a propyl group, or a butyl group), an amino group, a vinyl group, a methacryl group, an isocyanate group, a mercapto group, a sulfur group, a ureide group, or an epoxy group, and specific examples thereof include silazane compounds (for example, silazane compounds having an alkyl group such as hexamethyldisilazane and tetramethyldisilazane; silazane compounds having an amino group such as 3-aminopropyl trimethoxysilane and N-2-(aminoethyl)-3-aminopropyl methyldimethoxysilane; silazane compounds having a vinyl group such as vinyltrimethoxysilane and vinyltriethoxysilane; silazane compounds having a methacryl group such as 3-methacryloxypropyl methyldimethoxysilane and 3-methacryloxypropyl trimethoxysilane; silazane compounds having an isocyanate group such as 3-isocyanatopropyl triethoxysilane; silazane compounds having a mercapto group such as 3-mercaptopropyl methyldimethoxysilane and 3-mercaptopropyl trimethoxysilane; silazane compounds having a ureide group such as 3-ureidopropyl triethoxysilane; silazane compounds having an epoxy group such as 3-glycidoxypropyl methyldimethoxysilane and 3-glycidoxypropyl triethoxysilane; and silane compounds such as methyltrimethoxysilane, dimethyldimethoxysilane, trimethylchlorosilane, and trimethylmethoxysilane) and organic siloxane compounds (for example, dimethylpolysiloxane). The organic silicon compounds may be used alone or in a combination of plural kinds thereof.

The supply amount of the silanol group-reactive sealant is from 0.004 mol to 0.5 mol and preferably from 0.004 mol to 0.24 mol with respect to 1 mol of the total supply amount of tetraalkoxysilane supplied per minute.

When the supply amount of the silanol group-reactive sealant is greater than or equal to 0.004 mol, silanol groups in the pores are likely to be substituted with substituents which are not reactive with a silanol group. As a result, irregular silica particles having a pore volume of from 0.05 $cm^3/g$ to 2.5 $cm^3/g$ are likely to be prepared. When the supply amount is less than or equal to 0.5 mol, the amount of pores is not excessive, and the water content to be retained in the pores is appropriate. When the supply amount is greater than 0.5 mol, the amount of pores is excessive, and the water content to be retained in the pores is large. As a result, image defects are generated by charge injection due to deterioration in electric resistance.

Through the above-described steps, irregular silica particles are obtained. At this time, the obtained irregular silica particles are in the dispersion state. From this irregular silica particle dispersion, the solvent is removed and powder of the irregular silica particles is extracted and used.

Examples of a method of removing the solvent from the irregular silica particle dispersion include well-known methods such as 1) a method of removing a solvent through filtration, centrifugal separation, distillation, or the like and drying the obtained material with a vacuum dryer, a shelf dryer, or the like; and 2) a method of directly drying slurry with a fluidized bed dryer, a spray dryer, or the like. The drying temperature is not particularly limited, but is preferably lower than or equal to 200° C. When the drying temperature is higher than 200° C., primary particles may be bonded to each other or coarse particles may be formed due to condensation of silanol groups which remain on surfaces of irregular silica particles.

The dried irregular silica particles may be optionally pulverized or sieved to remove coarse particles or aggregates. A pulverizing method is not particularly limited. For example, a dry pulverizer such as a jet mill, a vibration mill, a ball mill, or a pin mill may be used. Examples of a sieving method include well-known methods using a shaking sieve, a wind classifier, and the like.

Hydrophobizing Treatment Step

The irregular silica particles obtained with the method of preparing irregular silica particles according to the exemplary embodiment may be surface-treated with a hydrophobizing agent and used.

As the hydrophobizing agent, for example, well-known organic silicon compounds having an alkyl group (for example, a methyl group, an ethyl group, a propyl group, or a butyl group) are used, and specific examples thereof include silazane compounds (for example, silane compounds such as methyltrimethoxysilane, dimethyldimethoxysilane, trimethylchlorosilane, and trimethylmethoxysilane; hexamethyldisilazane; and tetramethyldisilazane). The hydrophobizing agents may be used alone or in a combination of plural kinds thereof.

Among the above hydrophobizing agents, organic silicon compounds having a trimethyl group such as trimethylmethoxysilane and hexamethyldisilazane are preferable.

The amount of the hydrophobizing agent used is not particularly limited, but in order to obtain a hydrophobizing effect, is from 1% by weight to 100% by weight and preferably from 5% by weight to 80% by weight with respect to the irregular silica particles.

Examples of a method of obtaining a hydrophobic irregular silica particle dispersion in which the irregular silica particles are surface-treated with the hydrophobizing agent include a method of adding a necessary amount of the hydrophobizing agent to the irregular silica particle dispersion to cause a reaction in a temperature range from 30° C. to 80° C. under stirring such that the irregular silica particles are surface-treated with the hydrophobizing agent and a hydrophobic irregular silica particle dispersion is obtained. When the reaction temperature is lower than 30° C., the hydrophobization reaction may be difficult to advance. When the reaction temperature is higher than 80° C., the gelation of the dispersion, the aggregation between the irregular silica particles, or the like may be likely to occur due to self-condensation of the hydrophobizing agent.

Examples of a method of obtaining powder of hydrophobic irregular silica particles include a method of obtaining a hydrophobic irregular silica particles dispersion with the above-described method and drying the dispersion with the above-described method to obtain powder of hydrophobic irregular silica particles; a method of drying the irregular silica particle dispersion to obtain powder of hydrophilic irregular silica particles and adding the hydrophobizing agent thereto for the hydrophobizing treatment to obtain powder of hydrophobic irregular silica particles; and a method of drying the obtained hydrophobic irregular silica particle dispersion to obtain powder of hydrophobic irregular silica particles and further adding the hydrophobizing agent thereto for the hydrophobizing treatment to obtain powder of hydrophobic irregular silica particles.

Examples of a method of hydrophogizing irregular silica particles as the powder material include a method of stirring powder of hydrophilic irregular silica particles in a treatment tank such as a Henschel mixer or a fluidized bed, adding the hydrophobizing agent thereto, and heating the treatment tank to gasify the hydrophobizing agent such that the gasified hydrophobizing agent is allowed to react with silanol groups on surfaces of the irregular silica particles as the powder material. The treatment temperature is not particularly limited, but is, for example, from 80° C. to 300° C. and preferably from 120° C. to 200° C.

Through the above-described steps, hydrophobic irregular silica particles are obtained.

The irregular silica particles may be used in combination with other external additives. Hereinafter, the external additives other than the irregular silica particles will be described.

Examples of other external additives include inorganic particles. Examples of the inorganic particles include particles of $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

It is preferable that surfaces of the inorganic particles as other external additives be treated with a hydrophobizing agent. The hydrophobizing treatment is performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. The above-described compounds may be used alone or in a combination of two or more kinds thereof.

The amount of the hydrophobizing agent is, for example, usually from 1 part to 10 parts with respect to 100 parts of the inorganic particles.

Other examples of the external additives include resin particles (for example, resin particles of polystyrene, PMMA, melamine, and the like) and cleaning agents (for example, metal salts of higher fatty acids as represented by zinc stearate and particles of fluorine-based polymers).

The amount of the above-described external additives added is, for example, preferably from 0.01% by weight to 5% by weight and more preferably from 0.01% by weight to 2.0% by weight with respect to the toner particles.

Method of Preparing Toner

Next, a method of preparing a toner according to the exemplary embodiment will be described.

The toner according to the exemplary embodiment is obtained by preparing the toner particles and externally adding the external additives to the toner particles.

The toner particles may be prepared with either a dry method (for example, a kneading pulverizing method) or a wet method (for example, an aggregation and coalescence method, a suspension polymerization method, or a dissolution suspension method). The method of preparing the toner particles is not limited to these methods, and well-known preparation methods may be adopted.

Among these, it is preferable that the toner particles be obtained with the aggregation and coalescence method.

Specifically, for example, when the toner particles are prepared with the aggregation and coalescence method, the toner particles are obtained through the following steps including a step (resin particle dispersion preparing step) of preparing a resin particle dispersion in which resin particles as a binder resin are dispersed; a step (aggregated particle forming step) of allowing the resin particles (optionally, other particles) to aggregate in the resin particle dispersion (optionally, which is mixed with another particle dispersion) to form aggregated particles; and a step (coalescing step) of heating an aggregated particle dispersion in which the aggregated particles are dispersed and allowing the aggregated particles to coalesce such that the toner particles are formed.

Hereinafter, each step will be described in detail.

In the following description, a method of obtaining toner particles which contain a colorant and a release agent will be described, but the colorant and the release agent are optionally used. Of course, additives other than the colorant and the release agent may be used.

Resin Particle Dispersion Preparing Step

First, in addition to a resin particle dispersion in which resin particles as a binder resin are dispersed, for example, a colorant particle dispersion in which colorant particles are dispersed and a release agent particle dispersion in which release agent particles are dispersed are prepared.

In this case, the resin particle dispersion is obtained, for example, by dispersing resin particles in a dispersion medium using a surfactant.

Examples of the dispersion medium which is used for the resin particle dispersion include an aqueous medium.

Examples of the aqueous medium include water such as distilled water or ion exchange water and alcohols. These aqueous mediums may be used alone or in a combination of two or more kinds thereof.

Examples of the surfactant include anionic surfactants such as sulfates, sulfonates, phosphates, and soaps; cationic surfactants such as amine salts and quarternary ammonium salts; and nonionic surfactants such as polyethylene glycols, alkylphenol ethylene oxide adducts, and polyols. Among these, anionic surfactants and cationic surfactants are preferable. Nonionic surfactants may be used in combination with anionic surfactants or cationic surfactants.

These surfactants may be used alone or in a combination of two or more kinds thereof.

Examples of a method of dispersing the resin particles in the dispersion medium to obtain the resin particle dispersion include general dispersing methods using a rotary shearing homogenizer and a ball mill, a sand mill, and a Dyno mill which have a medium. In addition, depending on the kind of resin particles, for example, a phase-transfer emulsification method may be used to disperse the resin particles in the resin particle dispersion.

In the phase-transfer emulsification method, a resin to be dispersed is dissolved in a hydrophobic organic solvent in which the resin is soluble, a base is added to an organic continuous phase (O phase) to neutralize the solution, and an aqueous medium (W phase) is put thereinto such that the transfer of the resin (so-called, phase-transfer) from W/O to O/W occurs to form a discontinuous phase, thereby dispersing the resin in a form of particles in the aqueous medium.

The volume average particle size of the resin particles which are dispersed in the resin particle dispersion is, for example, preferably from 0.01 μm to 1 μm, more preferably from 0.08 μm to 0.8 μm, and still more preferably from 0.1 μm to 0.6 μm.

The volume average particle size is measured as the volume average particle size D50p which is a cumulative value of 50% in a volume cumulative distribution with respect to all the particles. The volume cumulative distribution is plotted from the smallest diameter side in particle size ranges (channels) which are divided based on a particle size distribution obtained by the measurement of a laser diffraction particle size distribution analyzer (for example, LA-700 manufactured by Horiba Ltd.). The volume average particle sizes of particles in other dispersions are also measured with the same method.

The content of the resin particles in the resin particle dispersion is, for example, preferably from 5% by weight to 50% by weight and more preferably from 10% by weight to 40% by weight.

For example, with the same preparation method as that of the resin particle dispersion, the colorant particle dispersion and the release agent particle dispersion are also prepared. That is, regarding the volume average particle size, dispersion medium, dispersing method, and content of the particles in the resin particle dispersion, the same shall be applied to those of colorant particles which are dispersed in the colorant particle dispersion and release agent particles which are dispersed in the release agent particle dispersion.

Aggregated Particle Forming Step

Next, the resin particle dispersion is mixed with the colorant particle dispersion and the release agent particle dispersion.

In the mixed dispersion, by heteroaggregation of the resin particles, the colorant particles, and the release agent particles, aggregated particles which have a diameter close to desired particle size of the toner particles and contain the resin particles, the colorant particles, and the release agent particles are formed.

Specifically, for example, while adding a coagulant to the mixed dispersion, the pH of the mixed dispersion is controlled to be acidic (for example, ph of from 2 to 5), a dispersion stabilizer is optionally added thereto, and the obtained dispersion is heated to approximately a glass transition temperature of the resin particles (specifically, in a temperature range from the glass transition temperature of the resin particles −30° C. to the glass transition temperature of the resin particles −10° C.) to allow the particles which are dispersed in the mixed dispersion to aggregate. As a result, aggregated particles are formed.

In the aggregated particle forming step, the above-described heating treatment may be performed, for example, after adding the above-described coagulant to the mixed dispersion at room temperature (for example, 25° C.) under stirring with a rotary shearing homogenizer, controlling the pH of the mixed dispersion to be acidic (for example, pH of from 2 to 5), and optionally adding the dispersion stabilizer thereto.

As the coagulant, for example, surfactants having a polarity opposite to that of the surfactant which is added to the mixed dispersion as the dispersant may be used, and examples thereof include inorganic metal salts and di- or higher-valent metal complexes. In particular, when the metal complex is used as the coagulant, the amount of the surfactant used is reduced, and charging characteristics are improved.

Optionally, an additive which forms a complex or a similar bond with metal ions of the coagulant may be used. As this additive, a chelating agent is preferably used.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide or calcium polysulfide.

As the chelating agent, a water-soluble chelating agent may be used. Examples of the chelating agent include oxycarboxylic acids such as tartaric acid, citric acid, and gluconic acid; imino diacid (IDA); nitrilotriacetic acid (NTA); and ethylenediamine tetraacetic acid (EDTA).

The amount of the chelating agent added is, for example, preferably from 0.01 part by weight to 5.0 parts by weight and more preferably greater than or equal to 0.1 part by weight and less than 3.0 parts by weight with respect to 100 parts by weight of the resin particles.

Coalescing Step

Next, the aggregated particle dispersion in which the aggregated particles are dispersed is heated to a temperature of the glass transition temperature of the resin particles or higher (specifically, to a temperature which is higher than the glass transition temperature of the resin particles by 10° C. to 30° C.) to allow the aggregated particles to coalesce. As a result, the toner particles are formed.

Through the above-described steps, the toner particles are obtained.

The toner particles may be prepared through the steps of: further mixing, after the aggregated particle dispersion in which the aggregated particles are dispersed is obtained, the aggregated particle dispersion with the resin particle dispersion in which the resin particles are dispersed to conduct aggregation so that the resin particles are further adhered to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

After the completion of the coalescing step, the toner particles formed in the solution are subjected to well-known steps including a washing step, a solid-liquid separating step, and a drying step. As a result, dried toner particles are obtained.

In the washing step, it is preferable that displacement washing be sufficiently performed using ion exchange water from the viewpoint of charging properties. In addition, in the solid-liquid separating step, although there is no particular limitation, it is preferable that suction filtration, pressure filtration, or the like be performed from the viewpoint of productivity. In addition, in the drying step, although there is no particular limitation, it is preferable that freeze drying, flush jet drying, fluidized drying, vibrating fluidized drying, or the like be used.

The toner according to the exemplary embodiment is prepared, for example, by adding the external additives to the dried toner particles thus obtained and mixing them. The mixing may be performed with, for example, a V-blender, a Henschel mixer, a Loedige mixer, or the like. Furthermore, optionally, coarse toner particles may be removed using a vibrating sieve, a wind classifier, or the like.

Electrostatic Charge Image Developer

An electrostatic charge image developer according to an exemplary embodiment of the invention includes at least the toner according to the exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and, for example, well-known carriers may be used. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin including an organosiloxane bond or a modified product thereof, a fluororesin, polyester, polycarbonate, a phenol resin, and an epoxy resin.

The coating resin and the matrix resin may contain other additives such as a conductive material.

In order to coat the surface of a core with the coating resin, for example, a coating method using a coating layer forming solution in which a coating resin, and optionally, various additives are dissolved in an appropriate solvent may be used. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to exemplary embodiments of the invention will be described.

The image forming apparatus according to this exemplary embodiment includes an image holding member; a charging unit that charges a surface of the image holding member; an electrostatic charge image forming unit that forms an electrostatic charge image on a charged surface of the image holding member; a developing unit that accommodates an electrostatic charge image developing toner and develops the electrostatic charge image, formed on the surface of the image holding member, using the electrostatic charge image developing toner to form a toner image; a transfer unit that transfers the toner image, formed on the surface of the image holding member, onto a surface of a recording medium; and a fixing unit that fixes the toner image transferred on the surface of the recording medium. As the electrostatic charge image developing toner, the electrostatic charge image developing toner according to the embodiment is used.

With the image forming apparatus according to the exemplary embodiment, an image forming method (image forming method according to the exemplary embodiment) is performed, the image forming method including a charging step of charging a surface of an image holding member; an electrostatic charge image forming step of forming an electrostatic charge image on a charged surface of the image holding member; a developing step of developing the electrostatic charge image, formed on the surface of the image holding member, using the electrostatic charge image developer according to the exemplary embodiment to form a toner image; a transfer step of transferring the toner image, formed on the surface of the image holding member, onto a surface of a recording medium; and a fixing step of fixing the toner image transferred on the surface of the recording medium.

The image forming apparatus according to the exemplary embodiment is applied to various well-known image forming apparatuses such as a direct transfer type apparatus in which a toner image, formed on a surface of an image holding member is directly transferred onto a recording medium; an intermediate transfer type apparatus in which a toner image, formed on a surface of an image holding member, is primarily transferred onto a surface of an intermediate transfer medium, and the toner image, transferred onto the surface of the intermediate transfer medium, is secondarily transferred onto a surface of a recording medium; an apparatus including a cleaning unit that cleans, after transferring a toner image, a surface of an image holding member before charging the surface again; and an apparatus including an erasing unit that irradiates, after transferring a toner image, a surface of an image holding member with erasing light to remove electricity before charging the surface again.

In the case of the intermediate transfer type apparatus, the transfer unit includes, for example, an intermediate transfer medium onto which a toner image is transferred; a primary transfer unit that primarily transfers the toner image, formed on a surface of an image holding member, onto the surface of the intermediate transfer medium; and a secondary transfer unit that secondarily transfers the toner image, transferred onto the surface of the intermediate transfer medium, onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that accommodates the electrostatic charge image developer and includes the developing unit is preferably used.

Hereinafter, an example of the image forming apparatus according to this exemplary embodiment will be described. However, the image forming apparatus according to this exemplary embodiment is not limited to this example. Major components illustrated in the drawing will be described, and the description of the other components will be omitted.

FIG. 1 is a schematic diagram illustrating a configuration of the image forming apparatus according to this exemplary embodiment.

The image forming apparatus illustrated in FIG. 1 includes first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, also simply referred to as "units") 10Y, 10M, 10C, and 10K are arranged in parallel in a horizontal direction thereof at predetermined intervals. These units 10Y, 10M, 10C, and 10K may be process cartridges that are detachable from the image forming apparatus.

An intermediate transfer belt 20 as an intermediate transfer member is provided above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. A spring or the like (not illustrated) applies a force to the support roll 24 in a direction away from the driving roll 22, and a tension is given to the intermediate transfer belt 20 wound on both of the rolls. In addition, an intermediate transfer member cleaning device 30 is provided on a surface of the intermediate transfer belt 20 on the image holding member side so as to face the driving roll 22.

Developing devices (developing units) 4Y, 4M, 4C, and 4K of the units 10Y, 10M, 100, and 10K are supplied with four color toners, that is, a yellow toner, a magenta toner, a cyan toner, and a black toner that are accommodated in toner cartridges 8Y, 8M, 8C, and 8K, respectively.

The first to fourth units 10Y, 10M, 100, and 10K have the same configuration. Here, the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 100, and 10K will be omitted.

The first unit 10Y has a photoreceptor 1Y acting as an image holding member. Around the photoreceptor 1Y, a charging roll 2Y (an example of the charging unit) that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 so as to be provided at a position opposed to the photoreceptor 1Y. Furthermore, bias supplies (not illustrated) that apply a primary transfer bias are connected to the primary transfer rolls 5Y, 5M, 5C, and 5K, respectively. Each bias supply changes a transfer bias that is applied to each primary transfer roll under the control of a controller (not illustrated).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with yellow image data sent from the controller (not illustrated). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed on the photoreceptor 1Y is rotated up to a predetermined developing position along with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically adhered to a latent image part of the surface of the photoreceptor 1Y which is erased, whereby a latent image is developed with the yellow toner. Next, the photoreceptor 1Y on which the yellow toner image is formed travels at a predetermined rate, and the toner image developed on the photoreceptor 1Y is continuously transported onto a predetermined primary transfer position.

When the yellow toner image on the photoreceptor 1Y is transported onto the primary transfer position, a primary transfer bias is applied to the primary transfer roll 5Y, an electrostatic force moving toward the primary transfer roll 5Y from the photoreceptor 1Y acts on the toner image, and the toner image on the photoreceptor 1Y is transferred onto the intermediate transfer belt 20. The transfer bias applied at this time has the opposite polarity (+) of the toner polarity (−), and is controlled to +10 μA, for example, in the first unit 10Y by the controller (not illustrated).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording paper (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force moving toward the recording paper P from the intermediate transfer belt 20 acts on the toner image, whereby the toner image on the intermediate transfer belt 20 is transferred onto the recording paper P. In this case, the secondary transfer bias is determined depending on the resistance detected by a resistance detector (not illustrated) that detects the resistance of the secondary transfer part, and is voltage-controlled.

Thereafter, the recording paper P is fed to a pressure-contacting part (nip part) between a pair of fixing rolls in a fixing device (an example of the fixing unit) 28 so that the toner image is fixed on the recording paper P, whereby a fixed image is formed.

Examples of the recording paper P onto which a toner image is transferred include plain paper that is used in electrophotographic copiers, printers, and the like. In addition to the recording paper P, an OHP sheet may also be used as the recording medium.

The surface of the recording paper P is preferably smooth in order to further improve smoothness of the image surface after fixing. For example, coating paper obtained by coating a surface of plain paper with a resin or the like, art paper for printing, and the like are preferably used.

The recording paper P on which the fixing of the color image is completed is discharged toward a discharge part, and a series of the color image forming operations ends.

Toner Container

A toner container according to an exemplary embodiment of the invention will be described.

The toner container according to the exemplary embodiment accommodates the electrostatic charge image developing toner according to the exemplary embodiment and is detachable from an image forming apparatus. Examples of the toner container include a process cartridge and a toner cartridge which are described below.

The process cartridge according to this exemplary embodiment includes a developing unit that accommodates the electrostatic charge image developer according to the exemplary embodiment and develops an electrostatic charge image, formed on a surface of an image holding member, using the electrostatic charge image developer to forma toner image, and is detachable from an image forming apparatus.

The process cartridge according to this exemplary embodiment is not limited to the above-described configuration, and may include a developing device and, optionally, at least one selected from other units such as an image holding member, a charging unit, an electrostatic charge image forming unit, and a transfer unit.

Hereinafter, an example of the process cartridge according to the exemplary embodiment will be illustrated. However, the process cartridge according to the exemplary embodiment is not limited this example. Major components illustrated in the drawing will be described, and the description of the other components will be omitted.

Figure 2:
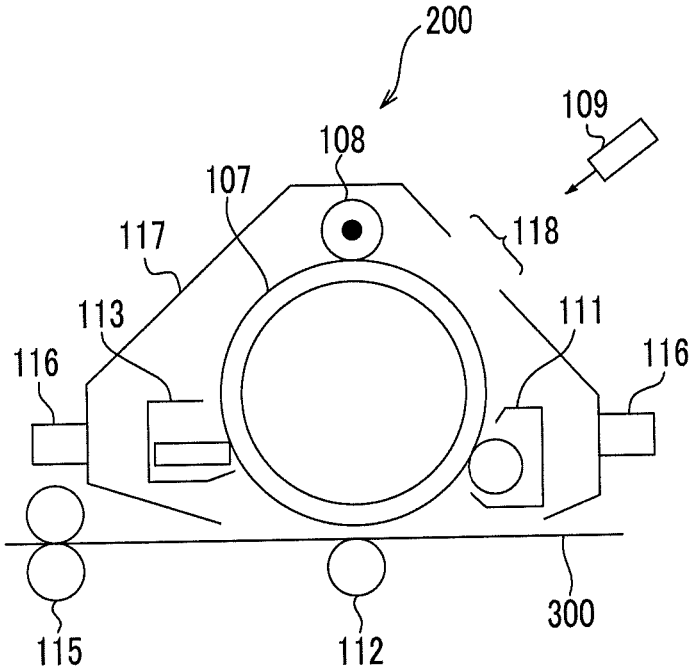
FIG. 2 is a schematic diagram illustrating a configuration of an example of a process cartridge according to an exemplary embodiment of the invention.

FIG. 2 is a schematic diagram illustrating a configuration of the process cartridge according to the exemplary embodiment.

A process cartridge 200 illustrated in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) provided around the photoreceptor 107 are integrally combined and held by, for example, a housing 117 provided with a mounting rail 116 and an opening 118 for exposure.

In FIG. 2, reference numeral 109 represents an exposure device (an example of the electrostatic charge image forming unit), reference numeral 112 represents a transfer device (an example of the transfer unit), reference numeral 115 represents a fixing device (an example of the fixing unit), and reference numeral 300 represents a recording paper (an example of the recording medium).

Next, a toner cartridge according to an exemplary embodiment of the invention will be described.

The toner cartridge according to the exemplary embodiment accommodates the toner according to the exemplary embodiment and is detachable from an image forming apparatus. The toner cartridge accommodates a toner for replenishment that is supplied to the developing unit provided in the image forming apparatus.

The image forming apparatus illustrated in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) through toner supply tubes (not illustrated), respectively. In addition, when the toner accommodated in the toner cartridge runs low, the toner cartridge is replaced.

EXAMPLES

Hereinafter, the exemplary embodiments will be described in detail using examples. However, the exemplary embodiments are not limited to these examples. In the following description, unless specified otherwise, "part(s)" and "%" represent "part(s) by weight" and "% by weight".

Preparation of Toner Particles

Preparation of Toner Particles (1)

Preparation of Resin Particle Dispersion (1)

Styrene (manufactured by Wako Pure Chemical Industries Ltd.): 320 parts n-Butyl acrylate (manufactured by Wako Pure Chemical Industries Ltd.): 80 parts β-carboxyethyl acrylate (manufactured by Rhodia Nicca Chemical Co., Ltd.): 9 parts 1',10-decanediol diacrylate (manufactured by Shin-Nakamura Chemical Co., Ltd.): 1.5 parts Dodecanethiol (manufactured by Wako Pure Chemical Industries Ltd.): 2.7 parts The above-described components are mixed and dissolved, and a solution obtained by dissolving 4 parts of anionic surfactant (DOWFAX, manufactured by Dow Chemical Company) in 550 parts of ion exchange water is added to the mixture. The obtained solution is dispersed and emulsified in a flask. Furthermore, 50 parts of ion exchange water in which 6 parts of ammonium persulfate is dissolved is added to the solution while slowly stirring and mixing the solution for 10 minutes. Next, after nitrogen substitution in the flask, the solution in the flask is heated to 70° C. in an oil bath under stirring, and emulsification polymerization is continued for 5 hours. As a result, an anionic resin particle dispersion (1) having a solid content of 41% is obtained.

Resin particles of the resin particle dispersion (1) have a central particle size of 196 nm, a glass transition temperature of 51.5° C., and a weight average molecule weight Mw of 32400.

Preparation of Resin Particle Dispersion (2)

Styrene (manufactured by Wako Pure Chemical Industries Ltd.): 280 parts n-Butyl acrylate (manufactured by Wako Pure Chemical Industries Ltd.): 120 parts β-carboxyethyl acrylate (manufactured by Rhodia Nicca Chemical Co., Ltd.): 9 parts The above-described components are mixed and dissolved, and a solution obtained by dissolving 1.5 parts of anionic surfactant (DOWFAX, manufactured by Dow Chemical Company) in 550 parts of ion exchange water is added to the mixture. The obtained solution is dispersed and emulsified in a flask. Furthermore, 50 parts of ion exchange water in which 0.4 part of ammonium persulfate is dissolved is added to the solution while slowly stirring and mixing the solution for 10 minutes. Next, after nitrogen substitution in the flask, the solution in the flask is heated to 70° C. in an oil bath under stirring, and emulsification polymerization is continued for 5 hours. As a result, an anionic resin particle dispersion (2) having a solid content of 42% is obtained.

Resin particles of the resin particle dispersion (2) have a central particle size of 150 nm, a glass transition temperature of 53.2° C., a weight average molecule weight Mw of 41000, and a number average molecule weight Mn of 25000.

Preparation of Colorant Particle Dispersion (1)

C.I. Pigment Yellow 74: 30 parts

Anionic surfactant (NEWREX R, manufactured by NOF Corporation): 2 parts

Ion exchange water: 220 parts

The above-described components are mixed, are preliminarily dispersed for 10 minutes with a homogenizer (ULTRA-TURRAX, manufactured by IKA Corporation), and are dispersed with a liquid-liquid counter collision system dispersing machine (ALTIMIZER, manufactured by Sugino Machine Ltd.) at a pressure of 245 MPa for 15 minutes. As a result, a colorant particle dispersion (1) having a central particle size of 169 nm and a solid content of 22.0% is obtained.

Preparation of Release Agent Particle Dispersion (1)

Paraffin wax (HNP9, manufactured by Nippon Seiro Co., Ltd., melting temperature: 75° C.): 45 parts Cationic surfactant (NEOGEN RK, manufactured by Daiichi Kogyo Seiyaku Co., Ltd.): 5 parts Ion exchange water: 200 parts The above-described components are mixed, heated to 100° C., dispersed with ULTRA-TURRAX T50 (manufactured by IKA Corporation), and dispersed with a pressure discharge type MANTON-GAULIN homogenizer. As a result, a release agent particle dispersion (1) having a central particle size of 196 nm and a solid content of 22.0% is obtained.

Preparation of Toner Particles (1)

Resin particle dispersion (1): 106 parts

Resin particle dispersion (2): 36 parts

Colorant particle dispersion (1): 30 parts

Release agent particle dispersion (1): 91 parts

The above-described components are put into a round stainless steel flask and are mixed and dispersed with ULTRA-TURRAX T50 (manufactured by IKA Corporation) to obtain a solution.

Next, 0.4 part of polyammonium chloride is added to this solution to prepare core aggregated particles, and dispersion treatment is continued using ULTRA-TURRAX. The solution in the flask is heated to 49° C. in a heating oil bath and is kept at 49° C. for 45 minutes. 36 parts of the resin particle dispersion (1) is added to the solution, thereby obtaining core-shell aggregated particles. Next, after adding 0.5 mol/L of aqueous sodium hydroxide solution to control the pH of the solution to 5.6, the stainless steel flask is sealed, is heated to 96° C. under stirring with a magnetic seal, is kept for 5 hours, and is cooled. As a result, yellow toner particles are obtained.

Next, the toner particles in a state of being dispersed in the solution are filtered and washed with ion exchange water, followed by solid-liquid separation by Nutsche suction filtration. The obtained solution is redispersed in 3 L of ion exchange water at 40° C., followed by stirring and washing at 300 rpm for 15 minutes. The above process is repeated 5 times. When the pH of the filtrate is 7.01, the electrical conductivity is 9.8 μS/cm, and the surface tension is 71.1 Nm, solid-liquid separation is performed by Nutsche suction filtration through No. 5A filter paper. The obtained solid material is dried in a vacuum for 12 hours. As a result, toner particles (1) having a volume average particle size of 4.5 μm are obtained.

Preparation of Toner Particles (2)

Toner particles (2) having a volume average particle size of 6.4 μm are obtained with the same preparation method as that of the toner particles (1), except that the solution is kept at 49° C. for 60 minutes.

Preparation of Silica Particles

Preparation of Silica Particles (1)

Granulation Step

Alkali Catalyst Solution Preparing Step

Preparation of Alkali Catalyst Solution 157.9 parts of methanol and 25.89 parts of 10% ammonia water are put into a glass reactor vessel with a volume of 3 L including a metal stirring rod, a dropping nozzle (TEFLON (trade name), microtube pump), and a thermometer, followed by stirring and mixing. As a result, an alkali catalyst solution is obtained.

Particle Forming Step (Preparation of Irregular Silica Particle Suspension)

Next, the temperature of the alkali catalyst solution is controlled to 35° C., and the alkali catalyst solution is subjected to nitrogen substitution. Then, while stirring the alkali catalyst solution, 28.73 parts of tetramethoxysilane (TMOS), 17.31 parts of ammonia water having a catalyst ($NH_3$) concentration of 3.8%, and 5.64 parts of hexamethyldisilazane (HMDS) as the silanol group-reactive sealant are simultaneously added dropwise thereto according to the following supply amount. As a result, a suspension of irregular silica particles (irregular silica particle suspension) is obtained.

The supply amount of tetramethoxysilane is 5.27 parts/min, the supply amount of 3.8% ammonia water is 3.18 parts/min, and the supply amount of hexamethyldisilazane is 1.03 parts/min.

(Drying Step)

Next, the obtained hydrophilic irregular silica particle suspension (hydrophilic irregular silica particle dispersion) is dried by spray drying to remove the solvent. As a result, powder of hydrophilic irregular silica particles is obtained.

Hydrophobizing Treatment Step 100 parts of the obtained powder of hydrophilic irregular silica particles is put into a mixer and is stirred at 200 rpm while being heated to 200° C. in a nitrogen atmosphere. 30 parts of hexamethyldisilazane (HMDS) is added dropwise with respect to the powder of hydrophilic irregular silica particles, followed by a reaction for 2 hours. Next, the obtained mixture is cooled to obtain hydrophobized powder of hydrophobic silica particles.

The obtained hydrophobic silica particles are set as silica particles (1). The silica particles (1) have an average equivalent circle size of 139 nm, an average circularity of 0.777, and a pore volume of 1.00 $cm^3/g$.

Preparation of Silica Particles (2) to (8) and (R1) to (R3)

Silica particles (2) to (8) and (R1) to (R3) are obtained with the same preparation method as that of the silica particles (1), except that the amount of methanol and the amount of 10% ammonia water in the alkali catalyst solution preparing step and the supply amount of tetramethoxysilane, the supply amount of 3.8% ammonia water, and the kind and supply amount of the silanol group-reactive sealant in the particle forming step are changed to conditions shown in Table 1. The respective particle sizes (average equivalent circle size), average circularity, and pore volume are as shown in Table 2.

Examples 1 to 8 and Comparative Examples 1 to 3

Preparation of Toner (1)

The toner particles (1) and the silica particles (1) are mixed with each other to externally add the silica particles (1) to the toner particles (1), thereby preparing a toner (1).

Toner (2) to (8) and (R1) to (R3)

Under the following preparation conditions of each toner, toners (2) to (8) and (R1) to (R3) are prepared.

Toner (2): The toner (2) is obtained with the same preparation method as that of the toner (1), except that the silica particles (2) are used instead of the silica particles (1).

Toner (3): The toner (3) is obtained with the same preparation method as that of the toner (1), except that the silica particles (3) are used instead of the silica particles (1).

Toner (4): The toner (4) is obtained with the same preparation method as that of the toner (1), except that the silica particles (4) are used instead of the silica particles (1).

Toner (5): The toner (5) is obtained with the same preparation method as that of the toner (1), except that the silica particles (5) are used instead of the silica particles (1).

Toner (6): The toner (6) is obtained with the same preparation method as that of the toner (1), except that the silica particles (6) are used instead of the silica particles (1).

Toner (7): The toner (7) is obtained with the same preparation method as that of the toner (1), except that the silica particles (7) are used instead of the silica particles (1).

Toner (8): The toner (8) is obtained with the same preparation method as that of the toner (1), except that the silica particles (8) are used instead of the silica particles (1).

Toner (R1): The toner (R1) is obtained with the same preparation method as that of the toner (1), except that the silica particles (R1) are used instead of the silica particles (1).

Toner (R2): The toner (R2) is obtained with the same preparation method as that of the toner (1), except that the silica particles (R2) are used instead of the silica particles (1).

Toner (R3): The toner (R3) is obtained with the same preparation method as that of the toner (1), except that the silica particles (R3) are used instead of the silica particles (1).

(Preparation of Developer)

Each toner which is obtained and a carrier are put into a V blender at a ratio of "toner:carrier=5:95 (weight ratio) and stirred for 20 minutes, thereby obtaining a developer.

The carrier used is prepared as follows.

1000 parts of Mn—Mg ferrite (manufactured by Powdertech Co., Ltd, volume average particle size: 50 μm, shape factor SF1: 120) is put into a kneader, and a solution obtained by dissolving 150 parts of perfluorooctyl methyl acrylate-methyl methacrylate copolymer (manufactured by Soken Chemical Engineering Co., Ltd., polymerization ratio: 20/80, Tg: 72° C., weight average molecular weight: 72000) in 700 parts of toluene is added thereto, followed by mixing at room temperature (25° C.) for 20 minutes. The obtained mixture is heated to 70° C. to be dried under reduced pressure and is taken out. As a result, a coating carrier is obtained. Furthermore, the obtained coating carrier is sieved through a mesh having an aperture of 75 μm to remove coarse powder, thereby obtaining a carrier. The shape factor SF1 of the carrier is 122.

Evaluation

A developing equipment of DocuCentre Color 400 (manufactured by Fuji Xerox Co., Ltd.) is filled with each developer which is obtained, and transfer omission and toner scattering are evaluated as follows. The results are shown in Table 2.

Evaluation of Transfer Omission

Transfer omission is evaluated as follows. This evaluation is performed in each environment of a ordinary-temperature and ordinary-humidity environment (25° C., 50 RH %) and a low-temperature and low-humidity environment (10° C., 10 RH %).

Specifically, an image is printed on an OHP sheet in the initial stage (second-printed image) and after printing 5000 images, and whether transfer omission occurs or not in the solid image is evaluated by visual inspection.

Evaluation criteria for transfer omission are as follows.

A: Transfer omission is not observed

B: A very small amount of transfer omission is observed on the OHP sheet

C: A small amount of transfer omission is observed on the OHP sheet

D: A significant amount of transfer omission is observed in a wide range on the OHP sheet Evaluation of Toner Scattering Toner scattering is evaluated as follows.

Specifically, toner scattering on a transfer medium (intermediate transfer belt) of DocuCentre Color 400 (manufactured by Fuji Xerox Co., Ltd.), which is used for the evaluation, is evaluated by visual inspection.

Evaluation criteria for toner scattering are as follows.

A: No toner scattering is observed

B: A very small amount of toner scattering is observed

C: A small amount of toner scattering is observed

D: Toner scattering is clearly observed

TABLE 1

| | Preparing Step | | | Particle Forming Step | | | | | | |
|---|---|---|---|---|---|---|---|---|---|---|
| | Alkali Catalyst Solution | | | Total Amount Added | | | Supply Amount (Part/min) | | | |
| | Methanol (Parts) | 10% Ammonia Water (Parts) | Reaction Temperature ° C. | TMOS (Parts) | 3.8% Ammonia Water (Parts) | Silanol Group-Reactive Sealant (Part(s)) | TMOS (Parts/min) | Ammonia Water (Parts/min)* | Silanol Group-Reactive Sealant (Part(s)/min)* | Silanol Group-Reactive Sealant Kind |
| Silica Particles (1) | 157.9 | 25.89 | 35 | 28.73 | 17.31 | 5.64 | 5.27 | 3.18 | 1.03 | Hexamethyldisilazane |
| Silica Particles (2) | 129 | 25.89 | 34 | 28.73 | 17.31 | 0.174 | 5.27 | 3.18 | 0.03 | Hexamethyldisilazane |
| Silica Particles (3) | 138.4 | 25.89 | 36 | 28.73 | 17.31 | 13.78 | 5.27 | 3.18 | 2.53 | Trimethylchlorosilane |
| Silica Particles (4) | 195.1 | 25.89 | 34 | 28.73 | 17.31 | 6.80 | 5.27 | 3.18 | 1.25 | Hexamethyldisilazane |
| Silica Particles (5) | 107.3 | 25.89 | 75 | 28.73 | 17.31 | 6.22 | 5.27 | 3.18 | 1.14 | Hexamethyldisilazane |
| Silica Particles (6) | 330.3 | 25.89 | 10 | 28.73 | 17.31 | 0.29 | 5.27 | 3.18 | 0.05 | Hexamethyldisilazane |
| Silica Particles (7) | 54.8 | 25.89 | 40 | 28.73 | 17.31 | 6.22 | 5.27 | 3.18 | 1.14 | Hexamethyldisilazane |
| Silica Particles (8) | 1076.9 | 25.89 | 40 | 28.73 | 17.31 | 2.73 | 5.27 | 3.18 | 0.50 | Hexamethyldisilazane |
| Silica Particles (R1) | 157.9 | 25.89 | 35 | 28.73 | 17.31 | 0 | 5.27 | 3.18 | 0 | — |
| Silica Particles (R2) | 330.3 | 25.89 | 35 | 28.73 | 17.31 | 14.95 | 5.27 | 3.18 | 2.74 | Hexamethyldisilazane |
| Silica Particles (R3) | 101.5 | 25.89 | 35 | 28.73 | 17.31 | 17.27 | 5.27 | 3.18 | 3.17 | Hexamethyldisilazane |

*The supply amount with respect to 1 mol of the total supply amount of tetraalkoxysilane supplied per minute

TABLE 2

| | Toner | | | | | | | | |
|---|---|---|---|---|---|---|---|---|---|
| | | | | Silica Particles | | | | | |
| | | Toner Particles | | | Average Equivalent Circle Size | Average Circularity | Pore Volume | Evaluation Results | |
| | No | No | Parts | No | (nm) | | ($cm^3/g$) | Transfer Omission | Toner Scattering |
| Ex. 1 | 1 | 1 | 2.3 | 1 | 139 | 0.777 | 1.00 | A | A |
| Ex. 2 | 2 | 1 | 2.3 | 2 | 140 | 0.75 | 0.06 | A | A |
| Ex. 3 | 3 | 1 | 2.3 | 3 | 138 | 0.76 | 2.4 | A | B |
| Ex. 4 | 4 | 1 | 2.3 | 4 | 140 | 0.8 | 1.2 | A | A |
| Ex. 5 | 5 | 1 | 1.1 | 5 | 70 | 0.72 | 1.1 | A | A |
| Ex. 6 | 6 | 1 | 3.7 | 6 | 230 | 0.84 | 0.08 | A | A |
| Ex. 7 | 7 | 1 | 2.1 | 7 | 130 | 0.55 | 1.1 | A | B |

TABLE 2-continued

| | Toner | | | | | | | | |
|---|---|---|---|---|---|---|---|---|---|
| | | | | Silica Particles | | | | | |
| | | Toner Particles | | | Average Equivalent Circle Size | Average | Pore Volume | Evaluation Results Transfer | Toner |
| | No | No | Parts | No | (nm) | Circularity | ($cm^3/g$) | Omission | Scattering |
| Ex. 8 | 8 | 1 | 2.1 | 8 | 130 | 0.88 | 0.5 | A | B |
| Comp. Ex. 1 | (R1) | 1 | 2.3 | (R1) | 139 | 0.777 | 0.04 | C | C |
| Comp. Ex. 2 | (R2) | 1 | 2.3 | (R2) | 140 | 0.84 | 2.6 | C | C |
| Comp. Ex. 3 | (R3) | 1 | 2.3 | (R3) | 141 | 0.71 | 3 | C | D |

It can be seen from the above results that, when Examples are compared to Comparative Examples, an image in which transfer omission is suppressed is obtained in Examples.

In addition, it can be seen that, when Examples are compared to Comparative Examples, toner scattering is suppressed in Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and silica particles, wherein the silica particles have an average equivalent circle size of from 70 nm to 250 nm, an average circularity of from 0.5 to 0.9, and a pore volume of from 1.0 $cm^3/g$ to 2.5 $cm^3/g$, and wherein the silica particles are formed from a tetraalkoxysilane and a silanol group-reactive sealant.

2. The electrostatic charge image developing toner according to claim 1, wherein the average equivalent circle size of the silica particles is from 80 nm to 200 nm.

3. The electrostatic charge image developing toner according to claim 1, wherein the average circularity of the silica particles is from 0.65 to 0.9.

4. The electrostatic charge image developing toner according to claim 1, wherein the average circularity of the silica particles is from 0.70 to 0.85.

5. The electrostatic charge image developing toner according to claim 1, wherein the pore volume of the silica particles is from 1.0 $cm^3/g$ to 1.2 $cm^3/g$.

6. The electrostatic charge image developing toner according to claim 1, wherein the pore size of the silica particles is from 1.7 nm to 150 nm.

7. The electrostatic charge image developing toner according to claim 1, wherein the pore size of the silica particles is from 3.0 nm to 100 nm.

8. The electrostatic charge image developing toner according to claim 1, wherein the pore size of the silica particles is from 5 nm to 25 nm.

9. The electrostatic charge image developing toner according to claim 1, wherein the amount of the silica particles which are externally added is from 0.01% by weight to 5.0% by weight with respect to the toner particles.

10. The electrostatic charge image developing toner according to claim 1, wherein the amount of the silica particles which are externally added is from 0.01% by weight to 2.0% by weight with respect to the toner particles.

11. A toner container which accommodates the electrostatic charge image developing toner according to claim 1 and is detachable from an image forming apparatus.

12. An image forming apparatus comprising:

an image holding member;

a charging unit that charges a surface of the image holding member;

an electrostatic charge image forming unit that forms an electrostatic charge image on a charged surface of the image holding member;

a developing unit that accommodates the electrostatic charge image developing toner according to claim 1 and develops the electrostatic charge image, formed on the surface of the image holding member, using the electrostatic charge image developing toner to form a toner image;

a transfer unit that transfers the toner image, formed on the surface of the image holding member, onto a surface of a recording medium; and a fixing unit that fixes the toner image transferred on the surface of the recording medium.

* * * * *